US006161353A

United States Patent [19]

Negola et al.

[11] Patent Number: 6,161,353

[45] Date of Patent: Dec. 19, 2000

[54] BACKERBOARD FOR CERAMIC TILES AND THE LIKE

[76] Inventors: Edward Negola, 3383 Stillhouse Rd., Atlanta, Ga. 30339; Arthur D. Gaynor, 10305 Shallowford Rd., Roswell, Ga. 30075

[21] Appl. No.: 09/159,970

[22] Filed: Sep. 24, 1998

[51] Int. Cl.[7] ..... E04C 2/20; E04C 2/32

[52] U.S. Cl. ..... 52/453; 52/344; 52/309.1; 52/98; 428/167

[58] Field of Search ..... 52/344, 309.1, 52/453, 384, 389, 390, 98, 100, 316, 385, 413, 444, 789.1; 428/167, 183

[56] References Cited

U.S. PATENT DOCUMENTS

| | | | |
|---|---|---|---|
| 1,594,261 | 7/1926 | Herschmann | 428/167 X |
| 1,778,345 | 10/1930 | Venzie | 52/453 |
| 1,930,024 | 10/1933 | Varden | 52/390 X |
| 3,008,256 | 11/1961 | Rice | 52/98 X |
| 3,533,896 | 10/1970 | Hartig . | |
| 3,800,335 | 4/1974 | Buonaura | 52/35 |
| 3,817,012 | 6/1974 | Wack et al. . | |
| 3,869,735 | 3/1975 | D'Amato | 52/453 X |
| 3,883,631 | 5/1975 | Murray | 264/210.2 |
| 4,290,248 | 9/1981 | Kemerer et al. | 52/309.16 |
| 4,318,258 | 3/1982 | Heck | 52/453 X |
| 4,324,605 | 4/1982 | Bethea | 52/389 X |
| 4,557,004 | 12/1985 | Piana | 4/614 |
| 4,612,238 | 9/1986 | Della Vecchia et al. | 442/180 |
| 4,932,182 | 6/1990 | Thomasson . | |
| 5,014,488 | 5/1991 | Evangelos et al. . | |
| 5,052,160 | 10/1991 | Gentsch et al. | 52/309.1 X |
| 5,052,161 | 10/1991 | Whitacre . | |
| 5,140,789 | 8/1992 | De Gooyer . | |
| 5,185,117 | 2/1993 | Hawley | 264/211.12 |
| 5,255,482 | 10/1993 | Whitacre . | |
| 5,371,980 | 12/1994 | Dix . | |
| 5,459,966 | 10/1995 | Suarez et al. | 52/309.1 X |
| 5,511,346 | 4/1996 | Kenworthy | 52/169.5 |
| 5,816,005 | 10/1998 | Han | 52/389 X |
| 5,857,297 | 1/1999 | Sawyer | 52/169.5 |
| 5,914,173 | 6/1999 | Fishel et al. | 428/156 |
| 5,946,878 | 9/1999 | Grund et al. | 52/630 |
| 5,954,601 | 9/1999 | Abrams et al. | 473/481 |

FOREIGN PATENT DOCUMENTS

| | | | |
|---|---|---|---|
| 2272242 | 12/1975 | France | 52/453 |
| 300732 | 9/1964 | Netherlands | 52/389 |

OTHER PUBLICATIONS

"Vinyl–Surfaced Drywall Is Base for Ceramic Tile", Engineering News–Record, p. 59, Nov. 1962.

*Primary Examiner*—Laura A. Callo
*Attorney, Agent, or Firm*—Schweitzer Cornman Gross & Bondell LLP

[57] ABSTRACT

A rigid backerboard for replacement or substitution for a cementuous backerboard. The board is formed of a compression molded plastic material, preferably nylon which is relatively thin, yet rigid. The board is embossed on both of its principal (upper and lower) surfaces to maximize surface area for contact with adhesive materials. The embossment on at least one of the sides is rectilinear, facilitating the cutting of standard sized rectangular panels into smaller rectangles. The embossment on the opposite side is designed to maximize adhesive contact area, a diamond pattern being preferable.

4 Claims, 1 Drawing Sheet

BACKERBOARD FOR CERAMIC TILES AND THE LIKE

BACKGROUND OF THE INVENTION

Hard surface material including slate, stone, ceramic tiles, marble, etc. has to be installed over a rigid surface that will not flex or "give". The rigid material is used to cover a floor or wall, and will accept the ceramic or hard surface materials and the mortar or cements used to attach them. This is true whether the construction is a new housing project or when renovating the floors or walls of an existing home or commercial structure.

Most residential homes are built on either a concrete slab or a wood frame sub-floor. The two types of surfaces are quire different. Each has special characteristics of material that will affect the type of flooring that is installed.

The subject of the present invention relates to a flooring and all similar types of hard surface flooring or wall tiles.

The material usually referred to as the floor is really the "skin" over the real floor of a structure. The real floor is a structural floor that holds up walls, furnishings of the house and occupants of the house. The floor also serves to keep out moisture and the elements of nature.

Floors that are to be covered with ceramic tiles, stone or other hard surface materials must be specifically constructed to accept these materials. Concrete slab floors are strong and durable and provide an excellent bonding for hard surface floor skins such as tile, stone, or marble. A concrete floor that is properly prepared will accept almost any type of hard surface flooring. While concrete is not waterproof, and retains a certain amount of moisture after it has been poured, it is easily adaptable for the installation of all hard surface flooring materials.

When installing ceramic tile on a concrete slab, a mortar bed typically is used. This is a procedure requiring great skill, and some mortar installations are older than written history. When installing hard surface materials over a concrete slab weight is not an issue. When installing ceramic or stone tile over a concrete slab floor, a mortar base is applied to the floor and the tiles are set level in the mortar. Grout is then applied in the spaces between the tile or stone.

The beauty and lasting durability and color of ceramic or stone tile make it a very desirable floor covering. Installing tile or stone on a concrete floor is relatively straight forward. A skilled craftsman applies a mortar base of cement over a screen that is designed to hold the mortar. More than one layer of mortar is usually necessary which means that time for the first layer to dry is necessary. A second layer of mortar is laid and the ceramic or stone tiles are installed in a grid like pattern.

U.S. Pat. No. 5,052,161 is of interest, as the patent explains in detail the old "mud setting bed" composed of at lean mixture of sand and cement. The patent describes how modern tile setting avoids direct bonding to concrete or wood substrates as such a system causes problems with cracking, especially on a cement subfloor or base. The patent calls for a thin plastic film containing bubbles to be placed between the base of wood or concrete and the ceramic tile with mortar attached. This is a thin film crack shield, which will expand or contract especially when installing tile over concrete. While the described method is useful for installing tile over a concrete sub-floor it is not as suitable as the present invention for installing ceramic tile over wood or on wall surfaces in bathrooms and kitchens. A rigid plastic board according to the present invention will provide a firm uncompressible base on a floor of wood or a wall made with wooden or metal studs.

Installing Ceramic Tiles Over Wooden Structure

It is desirable to be able to install a ceramic tile or stone over a wooden or non-concrete slab floor. This is a much more difficult installation, as plywood or other wooden sub-floors are not proper surfaces for the setting of mortar used as a base to accept the stone or ceramic hard surface material. Water and moisture contained in the mortar necessary for the ceramic installation will penetrate the wood sub-floor and cause it to warp resulting in a poor or cracked installation. A specially treated wood is more expensive than the commonly used plywood.

Most multilevel homes in the United States have wooden sub-floors. When ceramic tile is being installed on a concrete floor, weight is not an issue; but is a great concern when installing a ceramic or hard surface floor on a plywood sub-floor. The weight of the stone floor and the materials used in installation must be taken into account. Total weight reduction will be an improvement when installing ceramic and stone flooring over a wood sub-floor.

In residential homes with a basement or crawl space, and in some commercial structures, sub-floors use a layer of plywood as the main flooring surface. The plywood is nailed over supporting floor joists or beams.

Plywood sub-floors flex when walked on. It is therefore necessary to attach a rigid backerboard over plywood in order to install a ceramic tile or stone floor. If a tile floor is installed directly over plywood the tile floor or grout will crack due to the flexing of the wood underneath. A thin plastic film with bubbles, as suggested in U.S. Pat. No. 5,052,161, is adequate over concrete but will not completely solve the problems presented by wood. Moisture from wet mortar necessary to attach the tile will warp the common type plywood used as the sub-floor. A thin film cannot be used as the base for cementing tiles to a wall.

To overcome this problem, skilled workers within the ceramic or stone flooring industry use a "backerboard" that is rigid. The most common rigid backerboard used today are composed of a cementious material encased in a fiberglass or plastic mesh material, which holds it together.

Cementious flooring backerboard is ¼ to ½ inch thick. The board is rigid, therefore once tile is installed over the rigid board; it will not crack due to flexing. A ¼ or ½ inch backerboard is usually the choice for use in the flooring industry. These are heavy usually weighing 40 pounds or 2.67 pounds per square foot. Cementious backerboards are also used in securing ceramic tile to tub surrounds and bathroom or kitchen walls. These backerboards are usually ¼ to ½ inch are heavy and difficult to work with.

The advantage of installing the cementious backerboard over plywood for a hard flooring material underlayment is the fact that it is rigid and that it will readily accept adhesives and mortars. The boards do not flex when walked on and resist moisture making a suitable surface for flooring. When used on walls or countertops the cementious backerboard can be thinner as it is not flexed, but it must be able to withstand wet or moist conditions found in bathrooms and other rooms ordinarily tiled on wall surfaces. The cementious backerboards used on walls, bathtub surrounds and countertops are usually ¼ thick as they do not have to support a walking person.

When attaching a cementious backerboard to a sub-floor, it is the preferred technique to apply a thin coating of adhesive or mortar to the plywood sub-floor before attaching the backerboard to the top of the plywood floor. The backerboard is usually screwed or nailed to the sub-floor every six inches and placed on joists separated on 16-inch centers to firmly secure the backerboard to the floor. Only enough mortar is applied to level and hold the board but not enough to warp the plywood underneath.

Adhesive or mortar is applied with a notched trowel over the top of the cementious backerboard and the tile is carefully laid out and attached to the adhesive and beat level. This same technique is used to set tiles on backerboards used as bath surrounds on walls and tubs. It is also the method used on countertops that have tile set into them.

Other advantages of using backerboard instead of wood is its ability to withstand moisture, steam, and other types of wetness common to rooms such as kitchens and bathrooms where ceramic tile is usually installed.

While cementious boards are the most common types of backerboards other types of boards such as "Dens-Shield" or "Hardy" backerboard have been introduced to the construction industry. These are slight variations to the backerboard and are made using cement, gypsum, thin plastic laminates and non-woven or fibrous materials. These boards serve the same purpose as the cementious backerboards but are slightly lighter in weight. This makes them easier to work with and more desirable to the craftsman.

U.S. Pat. No. 5,255,482 is a disclosure of a complete flooring structure that consists of a ceramic tile installed over a rigid base, preferably concrete having a crack isolation layer comprised of a plurality of precast sheets made of fired clay, cement or thermosetting resins such as phenolic or two part reactive epoxies or urethane. This disclosure shows the need to overcome expansion and contraction associated with concrete floors. The invention utilizes a sheet containing holes in 20 to 50% of the area available for placing the floor tiles. This approach is useful on concrete but fails to solve the problem of installing ceramic tiles on wooden floors or attaching to studs of a wall.

Another type of backerboard used is plywood specially treated so that it will accept adhesives and mortar designed to set ceramic or stone tile. The plywood is called marine grade and is very expensive. This method is not commonly used because this type of treated plywood is very expensive.

Most cementious backerboards are not structurally sound. Dropping or mishandling a backerboard will result in breakage or crumbling. They must be installed over a plywood sub-floor and are used strictly to provide a rigid surface that will not stress or bend and will readily accept adhesives and mortar used in the hard surface flooring industry. The same boards cannot be used interchangeably for floors and walls.

Cementious backerboards that are common to the industry have many disadvantages that the present invention will overcome. One of the main disadvantages of a cementious backerboard is the fact that it is very heavy. The most used board is 3 ft×5 ft ½-inch board and weighs 40 pounds or 2.67 pounds per square foot. This added weight must be taken into consideration when assessing whether the floor will support the stone tile or whether it will have to be reinforced. It is also difficult for the skilled craftsman to work with such a heavy board.

Another disadvantage is the fact that cementious backerboards crumble and break very easily. Cementious backerboard are difficult to cut to shapes and sizes other than rectangles and require special tools to accomplish irregular shaped cuts. When the cementious boards are cut with power tools, workers are exposed to dust and other harmful particles. Warnings are commonly placed on these boards to warn the craftsman of the dangers of mishandling.

The heavy weight of the backerboard adds expense for labor and freight. Heavy cementious backerboards that crumble and break require more that one person to carry and transport them when working on a relatively small job. It has been determined by the industry that for a cementious flooring backerboard to provide adequate support, it has to be ½ inch thick. The most common size used for flooring backerboard is 3 ft×5 ft×½" when made from a cementious material.

Other boards such, as "Hardybacker" are composed of Portland cement, sand, and cellulose fiber. These boards reduce the problems but still are difficult to work with for the same reason as the cementious boards. They are also brittle and heavy, weighing 30 pounds per 3×5 board.

Another product, "Dens-Shield" by Georgia Pacific, is made using gypsum, plastic laminate, and non-woven fibrous laminate. This backerboard is lighter than cementious board but is not as rigid as a cementious board. This board is easily damaged and breaks with normal construction type of handling. Gypsum also absorbs moisture and mortar and is not suitable for most residential flooring construction jobs. When used on floors a flexing occurs which will cause the installed floor to crack.

There is a great need for a rigid backerboard that can be used when installing ceramic tiles on floors, walls, countertops and in other places where mortar or cements should not be directly applied. Ideally the backerboard has to be light in weight, easy to carry and will not be affected by moisture and should be able to withstand flex. In addition, the board should be useful for installing ceramic or stone materials on flooring, walls and countertops. Presently only heavy cementious boards, that are difficult to work with, or expensive specially treated plywood, are available to the construction industry. A great need exists for a backerboard that is rigid, accepts mortar and adhesives, is lightweight and easy to work with.

In addition to the above desirable characteristics, a material that will easily accept flame retardant, anti-microbial chemicals and insect repellents approved by the EPA would be useful in the manufacture of backerboard. The uses for this material would not be limited to the installation of ceramic tile and stone but one skilled in the art could use the boards in other areas such as backerboard for light weight stucco and sheathing in areas where these characteristics are desirable such as non supporting structural trim finish on the outside of buildings.

SUMMARY OF THE INVENTION

The present invention relates to a compression molded thermoplastic backerboard preferably containing at least 20% nylon 6 or nylon 66 or both nylon 6 and 66 combined with a mixture of olefins both high and low density that can be used as a replacement of a cementious backerboard in the ceramic or stone tile industry for a flooring, wall or countertop underlayment. The plastic board is made so that it is rigid enough to be an adequate substitute for a cementious backerboard. This rigid plastic board is made to the same square foot dimensions as a cementious backerboard. The thermoplastic board can be nailed or screwed to a plywood sub-floor with or without an adhesive or can be attached to two-by-four studs that form the wall in conventional construction. A common size of the plastic board would be 3 ft×5 ft×⅜". The invention is not limited to this size and a board can be made to suit the need of the industry by changing a mold size. While a mixture containing at least 20% nylon is the most preferred, one skilled in the art can compression mold a suitable thermoplastic board using a mixture of olefins and cellulosic fibers. This method is outlined in an example that follows.

In one embodiment, it is preferable that the rigid thermoplastic board has a roughened surface molded onto the face. This roughened surface will enhance the ability to hold a mortar or adhesive. A sandy adhesive mortar is commonly used to secure ceramic tiles to floors, walls or countertops. One skilled in the molding art can create the surface many ways. A preferred embodiment would be a molded diamond shape on top with a 1.5×1.5 inch repeat and a square pattern of 1.5×1.5 on the bottom. In addition, a score mark or line preferably is imbedded on the back to make it easy to snap or cut.

The thermoplastic board made according to this invention is rigid and can be used to replace cementious board. This plastic board prevents harmful flexing avoiding cracking and crumbling of the tile and grout when the floor is walked on. In addition, the board is easy to saw, screw, or nail to other wood surfaces such as plywood or studs used to form floors, countertops or walls. The rigidity of the plastic board is accomplished by using a method called compression molding. A pressure of at least 20,000 psi and up to 50,000 psi is used to press and form the board. One skilled in the art may vary this pressure depending on the type of thermoplastic mixture used.

It is preferable to roughen or emboss both sides of the board when it is to be used as a floor or wall material. Roughened surfaces on both sides of the board enables the board to be laid on a thin set mortar base before it is nailed or screwed to the wooden sub-floor. The added surface area allows the board to set more easily in the adhesive or mortar. When applied to studs on a wall, the outer surface will readily accept adhesive used to secure wall tiles. The same board can be used for floors or walls.

Another advantage to using the rigid thermoplastic board is the fact that mortar or other liquids common in households will not penetrate the board. It will also be evident to one skilled in the art that the board is much easier to work with than a cementious board for the following reasons:

- It is at least 30% lighter in weight than cementious backerboard.
- Cuts easily with common tools without crumbling.
- Edges are smooth and do not require extensive filling with mortar.
- Roughened surface allows for better "bite" or "grip" when applying thin set mortar.
- It works on floor, wall, or countertop applications without modification.
- It is moisture and water resistant
- It can accept additives and chemicals used in the ceramic tile industry The mixture of plastic and other material used to make this board is compounded to feed a pulsing type of machine called a kinetic mixer/extruder. The material is compounded to feed the kinetic mixer using a California pellet mill or a similar machine designed not to melt the material completely. The kinetic mixer enables the material for the invention to be heated and extruded enough to be placed in the proper compression mold. This is accomplished in the kinetic mixer by a series of rapidly spinning blades forcing the mixture to heat through friction. If a conventional extruder was used the material would form a plastic drool and not be useful to be placed in a compression mold. Plastic dough like substance called a billet must be formed in order to be placed in a compression mold. In the preferred embodiment the plastic material must be forced to flow in the compression mold and withstand at least 20,000 psi to 50,000 psi. It then must be easily removed from the mold.

Ideally, the thermoplastic board formed in this manner will be from ⅛" thick to ½" thick but the invention is not limited to this dimension. Plastic material such as nylon, polyester, polypropylene, olefin, and vinyl are the thermoplastics of choice. The ideal dimension is 3 ft×5 ft×⅜" or 15 square foot.

Ideally at least 20 percent nylon or polyester must be used in the blend of the thermoplastic material to create the most preferred board. The invention can be made using cellulosic materials without nylon or polyester but we have found that the nylon or polyester is the preferred material that enables the board to be rigid and to impart the qualities necessary for the successful use in the ceramic tile wall and flooring industry. In addition the material is slightly moisture absorbent and easy to work with using conventional tools.

Walls and countertops do not have the same flexural requirements, as flooring materials and one skilled in the art would adjust the composition using less nylon and polyester.

Color is not essential but when color is required pigmented chips of any shade could be compounded into the plastic before molding. In addition, additives common to the plastics industry such as anti microbial, insect repellents and flame retardant can be used by one skilled in the art to enhance the characteristics of the invention. These chemicals would be especially useful in areas that ordinarily have fungus or insect problems.

For a more complete understanding of the invention, reference should be made to the following detailed description of preferred embodiments thereof, and to the accompanying drawing.

DETAILED DESCRIPTION OF INVENTION

Figure 1:
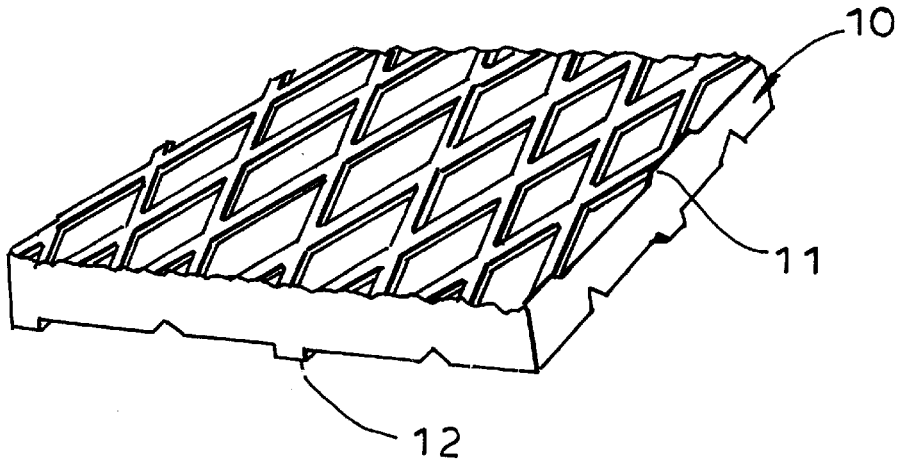
FIG. 1 is a fragmentary top perspective view of a backerboard panel constructed in accordance with the invention.

A mixture of type 6, 66 nylon, polyester and olefin is used to manufacture a thermoplastic backerboard product manufactured using a compression molding process. The invention is a thermoplastic rigid backerboard that is a superior substitute for cementious backerboards presently used in the ceramic tile industry as underlayments for flooring, walls and countertops. This invention is a product that is a strong, rigid plastic backerboard substantially lighter than the current cementious backerboard and is easy to work with using tools common to the trade. It can be nailed or screwed into a supporting wood surface. Thin set mortar common to the ceramic tile industry will adhere and secure tile to its surface. The invention is 3 ft×5 ft by ⅜ plastic board with roughened surfaces. The board is not limited to this size and can be molded to any common size that the requires. The size is limited only by the size of the molds necessary and available in the compression molding industry. Various combinations or nylon and olefin/cellulosics were used to produce an acceptable rigid backerboard that satisfy the needs of the industry.

Since many blends of plastic will make a satisfactory board when compression molded, The best way to describe the invention is to present examples of how the board was made and the results thereof.

EXAMPLE 1

Prepare a blend by mixing pellets of nylon, polypropylene, and high-density olefin in the following proportions:

40 percent nylon 20 percent olefin high density 40 percent polypropylene

This blend is fed into an kinetic mixer designed to mix and heat the material to the glass transition temperature of nylon (340–400 degrees Fahrenheit). A kinetic mixer is not a conventional extruder and generates heat only through friction of moving blades. The material is expelled from the Kinetic Mixer/extruder as a plastic molding dough called a billet and placed on a platen or form in a compression type molding machine. The molding machine presses the material using 30,000 psi into the form for approximately 2 minutes.

The excess material flowing out the edges of the mold is then removed to be used in the next batch. The pressure is released from the compression mold after two minutes has elapsed. Approximately one minute is allowed so the material is cool enough to remove from the mold.

The finished product was a rigid board 10 with a diamond plate molded surface 11 on one side and a flat surface (not shown) on the other side.

The board was cooled with a water spray and quickly dried in the atmosphere. The board was rigid and is ⅜" thick. For testing purposes the board was cut into squares using a saw designed to cut plastic. The cuts were even, smooth, and accurate. The board was not warped, remained flat, and did not have an objectionable odor.

A skilled tile craftsman tested the board. It was successfully nailed to a wood floor sample. It was successfully screwed to a wood floor sample. Thin set mortar was applied and ceramic tile was set successfully on the board. The board is a good substitute for the present day cementious board.

Figure 2:
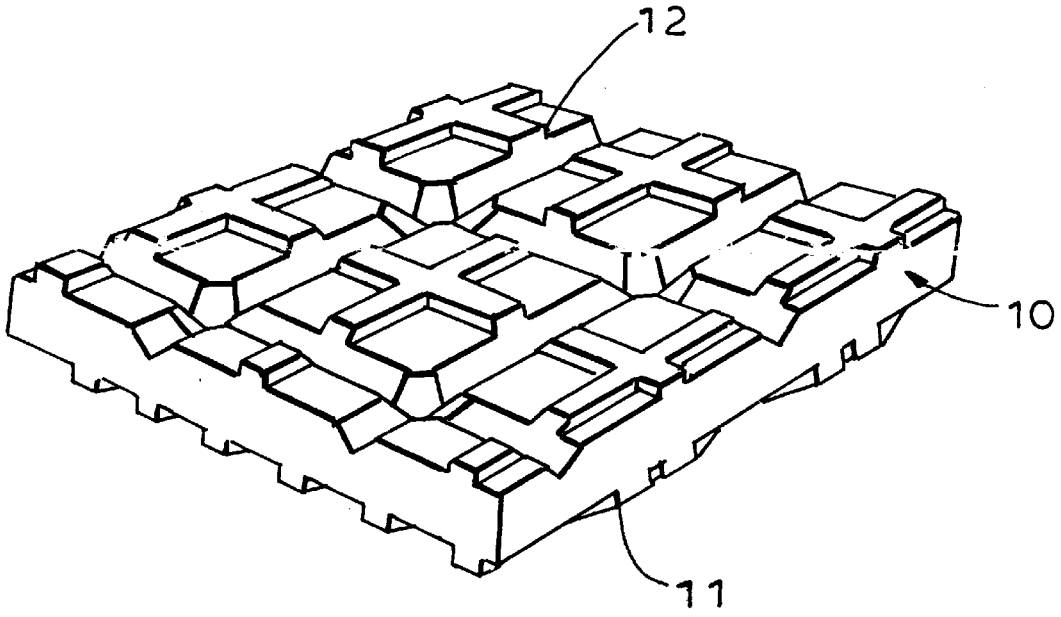
FIG. 2 is a fragmentary bottom perspective view of the panel of FIG. 1.

The tile craftsman noted that embossing both sides of the board, as at 11 in FIG. 1 and 12 in FIG. 2, would improve characteristics for use as a flooring board. The thin set mortar has a better "bite" or hold on the roughened surface than on the flat side surface.

EXAMPLE 2

50 percent nylon textile shred 20 percent polypropylene pellets 30 percent high-density olefin pellets The blend is fed into an kinetic mixer designed to mix and heat the material to the glass transition temperature of nylon (340–400 degrees Fahrenheit). The material is expelled from the Kinetic Mixer/extruder as a plastic molding dough called a billet and placed on a platen or form in a compression type molding machine. The molding machine pressed the material under 30,000 psi into the form for approximately 2 minutes.

The excess material flowing out the edges of the mold is then removed to be used in the next batch. The pressure is released from the compression mold after two minutes has elapsed. Approximately one minute is allowed so the material is cool enough to remove from the mold.

The finished product 10 has a diamond plate molded surface 11 on one side and a flat surface (not shown) on the other side.

The board was cooled in secondary cooling jig comprised of compression sections consisting of steel rollers cooled with chilled water. The board was rigid and is ⅜" thick. The board was cut into squares using a saw designed to cut plastic. The cuts were even, smooth, and accurate. The board was flat and did not have an objectionable odor.

A skilled tile craftsman tested the board. It was successfully nailed, screwed to a wood floor sample. Thin set mortar was applied and ceramic tile was set successfully on the board.

It was noted that embossing both sides of the rigid board would improve the characteristics for use as a flooring board. The thin set mortar has a better "bite" or hold the roughened surface then on the flat side surface.

EXAMPLE 3

A mixture of shredded textile material consisting of:

50 percent nylon textile shred 25 percent polypropylene textile shred 20 percent high-density olefin film shred 5 percent nylon 12 film shred This blend is fed into an kinetic mixer designed to mix and heat the material to the glass transition temperature of nylon (340–400 degrees Fahrenheit). The material is expelled from the Kinetic Mixer/extruder as a plastic molding dough called a billet and placed on a platen or form in a compression type molding machine. The molding machine pressed the material under 30,000 psi into the form for approximately 2 minutes.

The excess material flowing out the edges of the mold is then removed to be used in the next batch. The pressure is released from the compression mold after two minutes has elapsed. Approximately one minute is allowed so the material is cool enough to remove from the mold.

The finished product 10 has a diamond plate molded surface 11 on one side and a flat surface (not shown) on the other side.

The board was cooled in secondary cooling jig comprised of compression sections consisting of steel rollers cooled with chilled mortar. The board was rigid and is ⅜" thick. The board was cut into squares using a saw designed to cut plastic. The cuts were even, smooth, and accurate. The board was flat and did not have an objectionable odor.

A skilled tile craftsman tested the board. It was successfully nailed, screwed to a wood floor sample. Thin set mortar was applied and ceramic tile was set successfully on the board.

It was noted that embossing both sides of the rigid board would improve the characteristics for use as a flooring board. The thin set mortar has a better "bite" or hold the roughened surface then on the flat side surface.

The board produced would be recognized by one skilled in the art as being far superior than what is generally needed for an underlayment or a backerboard in the ceramic flooring industry.

One skilled in the art would vary the amount of nylon by reducing its content to a point where the board was rigid enough to be used as a replacement for cementious board. The cost would be reduced substantially by reducing the nylon content.

We feel that the nylon content of between 20–40 percent would be adequate. A further embodiment of the invention would be to add fillers such as natural cellulosics or fiberglass.

40 percent cellulosic fibers by weight was added to the mixtures as follows:

EXAMPLE 4

40 percent cellulosic fiber 30 percent nylon shred textile 30 percent olefin pellets You have to be careful to control the temperature of the kinetic mixture or blend. The temperature has to kept below the burn temperature of the cellulosic fiber. This would be 300–340 degrees Fahrenheit.

The material is expelled as a plastic molding dough or billet and is then placed on a plate or form in a compression type molding machine. The molding machine presses the material under 30,000 psi into the form for approximately 2 minutes.

The excess material flowing out the edges of the mold is then removed to be used in the next batch. The pressure is released from the compression mold after two minutes has elapsed. Approximately one minute is allowed so the material is cool enough to remove from the mold.

The finished product 10 has a diamond plate molded surface 11 on one side and a flat surface (not shown) on the other side.

The board was cooled in secondary cooling jig comprised of compression sections consisting of steel rollers cooled with chilled mortar. The board was rigid and is ⅜" thick. The board was cut into squares using a saw designed to cut plastic. The cuts were even, smooth, and accurate. The board was flat and did not have an objectionable odor.

A skilled tile craftsman tested the board. It was successfully nailed, screwed to a wood floor sample. Thin set mortar was applied and ceramic tile was set successfully on the board.

It was noted that embossing both sides of the rigid board would improve the characteristics for use as a flooring board. The thin set mortar has a better "bite" or hold the roughened surface then on the flat side surface.

The board produced would be recognized by one skilled in the art as being far superior than what is generally needed for an underlayment or a backerboard in the ceramic flooring industry.

One skilled in the art would vary the amount of nylon by reducing its content to a point where the board was rigid enough to be used as a replacement for cementious board. The cost would be reduced substantially by reducing the nylon content.

EXAMPLE 5

30 percent polypropylene 30 percent high density polyethylene 40 percent cellulosic fiber This blend is fed into an kinetic mixer designed to mix and heat the material to the glass transition temperature of polypropylene (275–300 degrees Fahrenheit). The material is expelled from the Kinetic Mixer/extruder as a plastic molding dough called a billet and placed on a platen or form in a compression type molding machine. The molding machine pressed the material under 30,000 psi into the form for approximately 2 minutes.

You have to be careful to control the temperature of the kinetic mixture or blend. The temperature has to kept below the burn temperature of the cellulosic fiber. This would be 275–300 degrees Fahrenheit.

The material is expelled as a plastic molding dough or billet and is then placed on a plate or form in a compression type molding machine. The molding machine presses the material under 30,000 psi into the form for approximately 2 minutes.

The excess material flowing out the edges of the mold is then removed to be used in the next batch. The pressure is released from the compression mold after two minutes has elapsed. Approximately one minute is allowed so the material is cool enough to remove from the mold.

The finished product 10 has a diamond plate molded surface 11 on one side and a flat surface (not shown) on the other side.

The board was cooled in secondary cooling jig comprised of compression sections consisting of steel rollers cooled with chilled mortar. The board was rigid and is ⅜" thick. The board was cut into squares using a saw designed to cut plastic. The cuts were even, smooth, and accurate. The board was flat and did not have an objectionable odor.

A skilled tile craftsman tested the board. It was successfully nailed, screwed to a wood floor sample. Thin set mortar was applied and ceramic tile was set successfully on the board.

It was noted that embossing both sides of the rigid board would improve the characteristics for use as a flooring board. The thin set mortar has a better "bite" or hold the roughened surface then on the flat side surface.

The board produced would be recognized by one skilled in the art as being far superior than what is generally needed for an underlayment or a backerboard in the ceramic flooring industry.

While the present invention has been described in what is presently considered to be the most practical and preferred embodiment, it is to be understood that the invention is not to be limited to the disclosed embodiments but on the contrary is intended to cover various modifications such as thickness, embossing designs and equivalence included within the spirit of the scope of the appended claims.

What is claimed is:

1. A rigid thermoplastic board suitable for use as an underlayment or backerboard for the installation of ceramic tile on a floor, wall, ceiling or counter tops, said board comprising (a) a rigid, flat rectangular panel formed of compression molded thermoplastic material, molded at a clamping pressure of at least 20,000 psi, (b) said panel having upper and lower principal surfaces and having embossments covering the entirety of both of said principal surfaces to provide increased surface area for the anchoring of adhesives, (c) said upper principal surface being adapted for the reception of tiles and said lower principal surface being adapted for mounting on a support surface, (d) the embossment on one of said surfaces being of rectilinear configuration to facilitate cutting of a panel to a smaller rectangular size.

2. A thermoplastic board according to claim 1, wherein (a) said thermoplastic material comprises at least 20% nylon.

3. A thermoplastic board according to claim 1, wherein (a) said rectilinear embossment is formed on said lower surface, and (b) the embossment on said upper principal surface is of a diamond configuration.

4. A thermoplastic board according to claim 3, wherein (a) said embossments are formed with a repeat of approximately 1.5 inches.

* * * * *